US008939136B2

(12) United States Patent
Gaus et al.

(10) Patent No.: US 8,939,136 B2
(45) Date of Patent: Jan. 27, 2015

(54) TOY FOR FLINGING MISSILE OR OTHER PROJECTILE

(75) Inventors: Douglas M. Gaus, Boise, ID (US); Caleb Chung, Boise, ID (US)

(73) Assignee: Douglas M. Gaus, Boise, ID (US)

( * ) Notice: Subject to any disclaimer, the term of this patent is extended or adjusted under 35 U.S.C. 154(b) by 673 days.

(21) Appl. No.: 13/207,289

(22) Filed: Aug. 10, 2011

(65) Prior Publication Data

US 2013/0037012 A1 Feb. 14, 2013

(51) Int. Cl.

| | |
|---|---|
| ***A63H 27/14*** | (2006.01) |
| ***A63H 33/18*** | (2006.01) |
| ***F41B 3/00*** | (2006.01) |
| ***F41F 7/00*** | (2006.01) |
| ***F41B 3/04*** | (2006.01) |

(52) U.S. Cl.

CPC *F41F 7/00* (2013.01); *A61H 33/18* (2013.01); *A63H 27/14* (2013.01); *F41B 3/04* (2013.01)

USPC ..... 124/5; 124/4; 124/81; 446/63; 446/213; 446/216; 473/569; 473/571; 473/578; 273/317

(58) Field of Classification Search

CPC ..... A63H 27/14; A63H 33/18; F41B 3/04

USPC ..... 124/4, 5, 51.1, 81; 473/569, 571, 578; 446/63, 213, 216; 273/317

See application file for complete search history.

(56) References Cited

U.S. PATENT DOCUMENTS

| | | | | | |
|---|---|---|---|---|---|
| 1,168,808 | A | * | 1/1916 | Hoffmann | 124/5 |
| 1,905,932 | A | * | 4/1933 | Foster | 124/5 |
| 2,352,260 | A | * | 6/1944 | Herman | 102/519 |
| 2,443,395 | A | * | 6/1948 | Lutins | 473/571 |
| 2,621,441 | A | * | 12/1952 | Worden | 446/34 |
| 2,705,148 | A | * | 3/1955 | Waller | 273/317 |
| 2,902,023 | A | * | 9/1959 | Waller | 124/5 |
| 3,002,314 | A | * | 10/1961 | Brottman | 446/15 |
| 3,264,777 | A | * | 8/1966 | McCreary, Jr. | 446/63 |
| 3,496,924 | A | * | 2/1970 | Miller | 124/5 |
| 3,557,768 | A | * | 1/1971 | Lake | 124/5 |
| 3,797,472 | A | * | 3/1974 | Knisely, Jr. | 124/5 |
| 3,841,292 | A | * | 10/1974 | Hoffman | 124/5 |
| 3,897,068 | A | * | 7/1975 | Staples | 473/233 |
| 3,898,765 | A | * | 8/1975 | Lee | 446/63 |

(Continued)

*Primary Examiner* — Melba Bumgarner
*Assistant Examiner* — Alexander Niconovich
(74) *Attorney, Agent, or Firm* — Hayes Soloway PC

(57) ABSTRACT

A hand-held flinging device includes a launcher that engages the projectile and improves control of the launcher and projectile, during a throwing/flinging motion, until centrifugal force causes disengagement of the projectile from the launcher. The engagement system involves the rearward portions of a launcher shaft and the projectile bore, so that, upon disengagement, frictional engagement and interference of the engagement system with the projectile is prevented or limited as the projectile moves forward to fly off the launcher. The engagement system may include a member that snaps into engagement with a hole or recess to hold the projectile on the launcher even through the wind-up portion of the throw that may include the launcher distal end being pointed downward. The preferred projectile covers the entire or nearly the entire launcher shaft distal of the hand grip and is heavier toward its front end. Even though the launcher does not have a shaft or "stick" that is long relative to the projectile length, the flinging device gives enough mechanical advantage that a projectile that is large and heavy compared to conventional foam darts can be flung a long distance with accuracy and consistency.

19 Claims, 9 Drawing Sheets

(56) References Cited

U.S. PATENT DOCUMENTS

| | | | | | |
|---|---|---|---|---|---|
| 3,949,518 | A | * | 4/1976 | Lenza | 446/186 |
| 4,003,574 | A | * | 1/1977 | MacDonald et al. | 473/613 |
| 4,030,472 | A | * | 6/1977 | Watkins | 124/5 |
| 4,076,006 | A | * | 2/1978 | Breslow et al. | 124/64 |
| 4,308,849 | A | | 1/1982 | Seregely | |
| 4,329,808 | A | * | 5/1982 | Rich et al. | 446/62 |
| 4,364,371 | A | * | 12/1982 | Woolard | 124/5 |
| 4,411,249 | A | * | 10/1983 | Fogarty et al. | 124/64 |
| 4,794,905 | A | * | 1/1989 | Woolard | 124/5 |
| 5,033,446 | A | * | 7/1991 | Bradt | 124/26 |
| 5,033,466 | A | | 7/1991 | Weymuller, Jr. | |
| 5,129,650 | A | * | 7/1992 | Hayman | 473/289 |
| 5,242,323 | A | * | 9/1993 | Rappaport | 446/180 |
| 5,253,866 | A | | 10/1993 | Moorman et al. | |
| 5,343,850 | A | * | 9/1994 | Steer | 124/64 |
| 5,392,755 | A | * | 2/1995 | Sutton | 124/5 |
| 5,471,968 | A | * | 12/1995 | Lee | 124/64 |
| 5,522,374 | A | * | 6/1996 | Clayton | 124/59 |
| 5,701,878 | A | * | 12/1997 | Moore et al. | 124/67 |
| 5,791,326 | A | * | 8/1998 | Brown et al. | 124/66 |
| 5,807,198 | A | | 9/1998 | Grimm | |
| 5,928,049 | A | * | 7/1999 | Hudson | 446/4 |
| 5,928,149 | A | | 7/1999 | Habraken | |
| 5,975,068 | A | * | 11/1999 | Halter et al. | 124/63 |
| 6,048,250 | A | * | 4/2000 | Hudson | 446/196 |
| 6,083,127 | A | * | 7/2000 | O'Shea | 473/571 |
| 6,732,725 | B2 | * | 5/2004 | Doud | 124/27 |
| 6,918,202 | B2 | * | 7/2005 | Merritt | 43/4.5 |
| 7,077,359 | B2 | * | 7/2006 | Poesch et al. | 244/63 |
| 7,861,698 | B2 | * | 1/2011 | Nordstog | 124/16 |
| 7,874,892 | B2 | * | 1/2011 | Hippely | 446/429 |
| 7,918,219 | B2 | * | 4/2011 | Belokin | 124/81 |
| 8,528,502 | B1 | * | 9/2013 | Gao | 119/708 |
| 2005/0103318 | A1 | * | 5/2005 | Leal et al. | 124/74 |
| 2006/0225719 | A1 | * | 10/2006 | Leal et al. | 124/71 |
| 2008/0207081 | A1 | * | 8/2008 | Erickson et al. | 446/61 |

* cited by examiner

TOY FOR FLINGING MISSILE OR OTHER PROJECTILE

BACKGROUND OF THE INVENTION

1. Field of the Invention

The invention relates generally to toys and sporting goods. More particularly, the invention relates to a hand-held launcher that may be used to fling a missile or other projectile in a game or competition. The launcher and projectile cooperate in such a way that the projectile remains on the launcher until the user reaches the end of the flinging action, which increases the predictability, consistency, and controllability of the flinging action and the resulting trajectory of the projectile.

2. Related Art

Several throwing toys are described in patent literature. For example, toys typically called "throwing sticks" have been patented by Von Hoffmann (U.S. Pat. No. 1,168,808, Jan. 18, 1916), Waller (U.S. Pat. No. 2,705,148, Mar. 29, 1955), Waller (U.S. Pat. No. 2,902,023, Sep. 1, 1959), McCreary, Jr. (U.S. Pat. No. 3,264,777, Aug. 9, 1966), Lee (U.S. Pat. No. 3,898,765, Aug. 12, 1975), Hoffman (U.S. Pat. No. 3,841,292, Oct. 15, 1974), Woolard (U.S. Pat. No. 4,364,371, Dec. 21, 1982), and Woolard (U.S. Pat. No. 4,794,905, Jan. 3, 1989).

Von Hoffmann is an early example of throwing sticks, wherein a ball or arrow slides freely on the stick in either direction, and is flung toward a target by a user. McCreary discloses an airplane that is thrown off of a stick, which stick appears to be tapered to a small diameter toward its distal end, so that airplane-stick contact is minimal especially at the distal end of the stick. Both Von Hoffmann and McCreary portray the stick as being held only generally upright in the rearward portion ("pull-back" or "wind-up") of the throwing motion, as it appears that the ball, arrow, and airplane would fall off the stick if the distal end of the stick were pointed any direction other than up. In both Von Hoffmann and McCreary, as in typical for throwing sticks, the stick is at least several times longer than the length/diameter of the object being flung.

Some of the throwing sticks make an attempt to hold the object to be flung on the stick until release, by means other than pointing the stick upwards and relying on gravity. Waller ('148) provides a portion (Waller call-out number 25) of the bore of the ball that has a reduced diameter that frictionally engages the surface of the shaft of the throwing stick. Hoffman provides a flexible throwing stick with an irregularly-shaped distal end, wherein the ball remains on at the distal end of the stick throughout the wind-up and until the centrifugal force culminates in "delivery" of the ball off the stick at the forward-most portion of the throw. Woolard ('371) discloses bowed leaf springs on the stick that are distal of the ball until the forward-most portion of the throw, whereby the ball is forced over the springs and off the stick. Woolard ('905) discloses a ball with a magnetic portion and a stick with a magnet proximal to the ball, wherein the centrifugal force disengages the ball from the magnet during the forward-most portion of the throw.

These prior throwing toys typically utilize a stick that is long relative to the ball or other toy projectile, for example, 1.5-10 times longer than the length of the ball/projectile. These prior throwing toys, even those that attempt to hold the object on the stick, tend to be difficult to handle, and difficult to control during the throwing action, resulting in inaccurate, inconsistent, and uncomfortable aiming and delivery of the ball/projectile to a target. These difficulties may be due in part to the length of the stick, which makes it difficult and even dangerous for a child to use. These difficulties may be due in part to free-sliding balls/projectiles, which result in dropped balls/projectiles and/or an unnatural throwing action as the user tries to keep the ball/projectile on the stick and deliver it with some force. Or, if some engagement or sliding limit is provided on the stick or ball/projectile, said engagement or sliding limit tends to be inconsistent and unpredictable in performance, again causing inaccurate, inconsistent and/or uncomfortable use.

There are many gun-shaped toys on the market for shooting projectiles, especially for combat play and dart-tag. These gun or machine-gun shaped toys shoot mainly soft projectiles, in the form of small foam darts of less than 1 inch in diameter, for example, NERF™ darts. The most common methods for mechanically launching these small foam projectiles are through the use of air or spring compression. Air compression is used for a popular toy machine-gun-style dart launcher where the foam darts are inserted into a dart magazine and a trigger is used on the gun to release the compressed air to cause the foam dart to shoot into the air. Other toy launchers use springs that are pulled or pushed into a compressed state on the toy, and, when a trigger is pulled, it releases the spring and launches the projectile. As these toys have become more popular, the toy manufacturers have begun to make the toy launchers larger in order to hold more of the same small projectiles and shoot the same projectiles in a quicker fashion, which has resulted in many of the toys being too heavy for a younger child to carry and use, especially for extending periods of play. Recently, several toy manufacturers have started selling toy crossbows (bow and string method) as another means to use a launcher for the small soft foam dart projectiles.

As the toy projectile shooting guns have gotten larger, manufacturers have started selling toys that mechanically launch moderately larger soft foam toy projectiles. However, these larger foam darts are substantially or entirely made of lightweight foam and, because of their light weight, are unable to travel long distances through the air. There is a limit to the size and weight of projectiles that mechanical means such as compressed air or spring compression can handle and shoot. Compressed air and/or springs would not provide enough power to shoot larger and heavier projectiles safely and with any performance distance or accuracy.

There are other larger foam toys on the market that are safe for outdoor play, such as foam footballs. Some of these toy footballs are made of heavier condensed (skinned polyethelene) foam and are made to be arm-thrown rather than by use of mechanical device.

There is a need, therefore, for an improved hand-held launching device able to launch larger and heavier soft foam projectiles with increased distance, speed, accuracy, consistency, and comfort, which typically translate into increased fun and exercise. There is a need for a launching device that throws or "flings" a projectile in an accurate and/or high and long trajectory that is controlled at least to some extent by the user. There is also a need for a throwing toy that is versatile, in that it can be used for many different games and adapted for many different projectiles, for example, generally-missile-shaped projectiles that include a head on an elongated body having fins, water-payload-carrying projectiles, and/or interchangeable heads on finned bodies.

SUMMARY OF THE INVENTION

The invention is a throwing device that comprises a hand-held launcher and a projectile that can, upon sufficient centrifugal force that results from a user's swinging or throwing action, fly off of the launcher in a trajectory away from the user. The launcher engages the projectile in a manner that holds the projectile on the launcher, and improves control of the launcher and projectile, during some or all of the throwing motion, including at least a portion of the "wind-up", until a time in the throwing motion that the centrifugal force causes disengagement of the projectile from the launcher and allows the projectile to fly forward/distally from the launcher and user.

The preferred throwing device comprises a launcher having a shaft that is slideably received in a body of the projectile, and an engagement system provided between the proximal regions of the shaft and the body. The engagement system is preferably located on/in the proximal region of the shaft and extends to touch/engage the proximal region of the projectile. This way, upon the projectile being forced in a distal direction away from the engagement system, and engagement system no longer places any drag on the projectile and there is preferably no frictional engagement between the projectile and the shaft except the sliding contact of preferably-smooth portions of the shaft and the body. The shaft and the bore of the projectile are preferably close to the same diameter along their entire lengths, and preferably smooth and not tapered. Thus, the shaft and bore remain closely mated together along the projectile's entire journey along the shaft, for creating an accurate trajectory, but the friction/interference of the engagement system is limited to the period of time that the projectile needs to be retained on the launcher (during wind-up and at least the early portion of the forward throwing motion).

The preferred projectile comprises a head with a body extending proximally from the head, wherein the center of gravity of the projectile is forward from midway along the length of the projectile. The projectile body may comprise, or may consist essentially of, a hollow tube wherein the hollow space of the tube is the bore received on the launcher shaft. The body/tube preferably comprises protrusions extending outward generally radially, for example, fins or wings that are rearward of the center of gravity of the projectile that help stabilize the trajectory of the projectile, tending to make the projectile perform like a missile. The outwardly-extending members may be elongated and may be slanted or curved to impart a spinning motion during the projectile's trajectory. The fins/wings or other generally-radial protrusions are located rearward (proximal) of the center of gravity of the projectile, are most preferably at or near the rear end of the projectile. Most preferably, at least 3 fins are provided, spaced around the circumference of the rear body/rear end, so that the fins are not co-planar and not generally co-planar.

The engagement system is located rearward (proximal) of the center of gravity, preferably in the rearward ¼, and more preferably in the rearward ⅛, or the rearward 1/16, of the length of the projectile, to limit friction/interference of the engagement system with the projectile except in the early portions of the throwing motion, as discussed above.

In an especially-preferred embodiment of the device, the projectile is installed on the launcher by being slid onto the shaft of the launcher, up to a stop surface or other limit. Upon this installation, with rotation of the projectile on the shaft in certain embodiments, a biased-member of the engagement system snaps into engagement to hold the projectile on the launcher. Preferably, the biased-member and a hole/recess that mate together for this engagement are in the launcher and projectile, respectively, to limit the time and the portion of the projectile path that the biased-member presses on the projectile. A hole/recess receiving the biased-member is preferred compared to a biased-member merely pressing against a flat, planar or curved (but not recessed or apertured) surface, due to enhanced reliability and consistency of the engagement between the biased-member and a hole/recess.

The preferred projectile, once installed on the launcher, preferably covers the entire or nearly the entire launcher shaft distal of the hand grip, or if a stop is provided separate from the hand grip, distal of the stop. The preferred projectile preferably is weighted toward its front, due to the relative size of its head and tail, and/or due to purposeful placement of weights and/or provision of hollow spaces. For example, a preferred projectile will have more than half of its weight, and more preferably 55-80% of its weight in its front half (distal half), the front/distal half being defined as being distal of a transverse plane midway (50% of the way) between a proximal-most extremity and a distal-most extremity of the projectile.

DETAILED DESCRIPTION OF THE PREFERRED EMBODIMENTS

Figure 1:
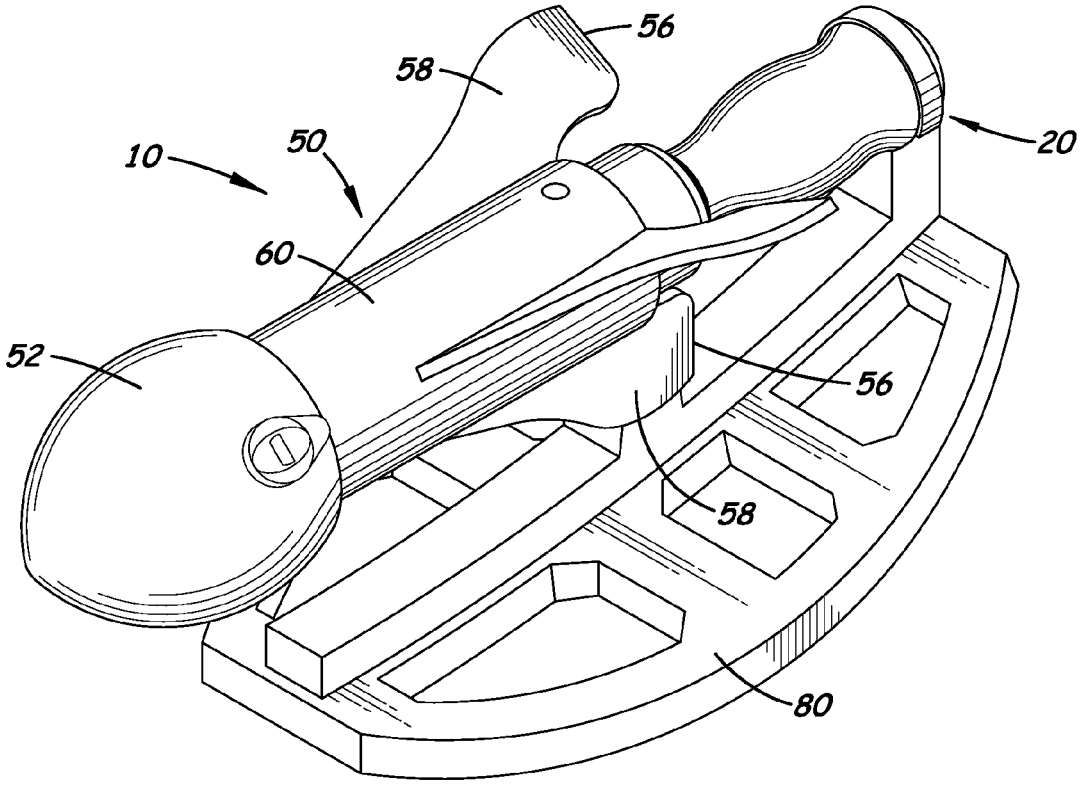
FIG. 1 is a side perspective view of one embodiment of the invented flinging device, which includes a launcher with a shield and a projectile installed on the launcher.

Objects of Certain Embodiments of the Invention

Objects of the invented toy device for flinging missile or other projectile may include one or more objects from the following paragraphs.

The device may be a safe, multi-use toy (for launching, throwing, catching, target use, and combat play) that effectively and efficiently launches larger and heavier foam type missiles with great performance, in terms of both accuracy and distance. The device may easily and effectively launch a multitude of generally-missile-shaped aerodynamic toys, including, but not limited to, missiles, darts, arrows, and bullets. Other ballistic shapes, such as footballs, baseballs, basketballs and the like, may be used partially or fully for the missile head and are combined with a body having preferably three or more tail fins near the body end.

The device uses centrifugal force in the form of a flinging/slinging arm motion by the user that does not require the user to press or release a button at any time, and especially not "at the perfect time", in order for the projectile to be released effectively and efficiently and with great performance. The device automatically holds the projectile firmly on the launcher during the first step of throwing (the pullback) but automatically releases the projectile from the launch device during the second step (forward throw) at the most opportune time for achieving the greatest effects of centrifugal force, in order to achieve the most efficient and effective release and subsequent flight performance. The disengagement of the projectile from the launcher may occur, for example, by the user utilizing a full throwing motion with the projectile being flung and released at a time during the forward portion of said full throwing motion, wherein said time may depend on the force/speed of the throwing motion, for example. For example, some users will use the device in a way that disengages the projectile from the engagement system before the launcher is pointed straight forward from the user. Alternatively, the user may abruptly stop the throwing motion, for example, stopping downward movement during the forward portion of the throwing motion, to produce an abrupt flinging effect.

The projectile may be quickly and effectively loaded onto the launch device for combat or sports play, and the launch device preferably does not include a stick that is much longer than the projectile and difficult for most users to handle and operate.

The device features a highly effective, non-mechanized launch device, which preferably has no moving parts other than the movement of the projectile on and off the launcher and, in certain embodiments, other than a biasing mechanism moving to disengage. The device relies on the user's arm for force, preferably rather than any wind-up, motor, or elastic mechanism to supply force to propel the projectile off the launcher.

The launcher may be adapted to include accessories, such as a shield that allows defensive actions, such as shielding the user from projectiles coming at them during combat or sports play. The shield may allow the user to "fend off" other players' projectiles or may simply be a fun, visual and symbolic item for play battles or competitions. The shield may be integrally attached to the launcher, or adapted to be easily detached and then re-attached to the launcher. The launcher may be fit with devices for holding extra projectiles, for example, one or more clips, hooks, ties, elastic bands, or cavities.

Many of the preferred projectiles are not uniform in their weight distribution, and, in fact, many projectiles preferably comprise a relatively large and/or heavy head, with a smaller and/or lighter rearwardly (proximally) extending (or "trailing") body. Such a weight distribution, with larger and heavier aerodynamically-shaped heads, will contribute to missile-like trajectory and performance. In many embodiments, the projectiles are generally symmetrical around the longitudinal axis of the projectile.

Many projectiles have more than 50% of their weight in the front half of the projectile, even though the relative size of the head and body may vary. The preferred launcher is able to launch projectiles of varying size (small, medium, large, and extra large), and projectiles that have varying size heads and bodies (large projectile heads with smaller projectile bodies or, smaller and/or shorter projectile heads with larger/longer projectile bodies). Even though the heads may be smaller or shorter than the projectile bodies, it is still preferred in most embodiments that the center of gravity be forward of midway along the length of the projectile.

The preferred launcher and projectile combination may allow the user to load and easily launch projectiles that are much larger than those from conventional foam-projectile toy weapons (such as NERF™ guns), but that are just as safe as conventional foam projectiles or even safer due to their having broader surfaces that will not gouge, poke, or otherwise damage an eye or other human or animal body part, a house, a car, a roof, a window or other property. Parents can allow their children to play with many embodiments of the invented device with no fear of injury or property damage.

A user may load, aim and easily launch larger but just-as-safe foam projectiles to a target placed on or attached to the ground, or attached on or to an outdoor object. The relatively large projectiles will tend to bounce off of surrounding objects without damaging the objects and are easy to find due to their size. The size of the launcher and projectiles may be sized appropriately for the age and strength of the users, for example, scaled-down for use by smaller and younger aged people, or scaled-up for use by older and bigger people. Smaller projectiles may be provided for indoor applications, such as target shooting and game play in a gymnasium, rec-room, or other room, however the projectiles will still preferably be larger than "foam-gun darts" and easier to find.

Some projectiles that cooperate with the preferred launcher spin clockwise or counterclockwise (in a spiral) after release from the launcher. This spinning may occur even if the launcher is designed not to impart a spinning motion to the projectile. For example, a projectile may not be inclined to spin from its original flight motion and release from the launch device (due to the launcher not rotating on its axis or impart a spinning motion to the projectile), but the shape/contour of the projectile may result in aerodynamics that spin the projectile at some point in its flight. In other words, this spinning may be due to the aerodynamic shape and placement of generally-protruding members such as fins or wings, or instead due to the presence of spiral grooves or indentations that cause rotation/spinning. To impart this spinning, the generally-protruding members such as fins or wings are preferably slanted or curved away from being exactly parallel to the longitudinal axis of the projectile. For example, embodiments wherein some or preferably all of the fins/wings are curved or slanted, and the curve/slant is in the same direction, will spiral clockwise or counterclockwise during some or all of the trajectory depending on which way the fins/wings curve/slant.

The projectiles may be fitted with one or more whistles and/or other noise-making devices. For example, a whistle may be placed on the projectile head or body in a location and orientation that causes whistling sounds as the projectile flies through the air. The whistle may include an easy means to turn the whistle on and off.

Electrical or non-electrical mechanisms may be included on the launcher and/or projectiles. For example, lights, glow-in-the-dark material, decorations, indicia, and/or reflective material may be applied or other incorporated. Optionally, motors may be incorporated, for example, for axial type spinning of the projectile when engaged.

Projectiles may be designed to perform banks, turns and loops and other aerodynamic tricks due to the shape of the wings and/or fins and combined with the fast speed and release from the launch device.

Projectiles may comprise heads that are made, for example, entirely of soft foam, or soft foam with interior empty pockets, or other material or composite/layered materials that are soft and non-dangerous. Heads may include material(s), such as open cell foam, or pocket(s) capable of holding liquid payloads. For example, materials or pockets may hold water or other liquids such as preferably-water-soluble paint. Projectiles may comprise at least a region of its head and/or body that is open cell foam, which holds water after being immersed in water. This way, a "water fight" with "water bombs" may be held between "combatants" for fun and cooling-off.

The preferred projectiles comprise a head, a trailing body (or "tail") with a smaller diameter than the head, and protruding members such as fins or wings on the trailing body. The head may be various shapes, for example, conical, rounded, or other shapes, or even shaped or decorated (including indicia, grooves, or stitching) in the likeness of a football, baseball, soccer, or basketball or other "commonly-recognized" shapes. In the case of football, baseball, soccer, basketball, or other "commonly-recognized" shapes, the entire shape may be used (preferably with a trailing body/tube extending out from the rear of the shape), or a portion of the shape may be used. For example, 50-90 percent of the commonly-recognized shape may be used, but the rear end (for example, the other 10-50 percent of the shape) may be adapted to better connect to the trailing body and/or to provide a more aerodynamic projectile. These commonly-recognized balls or other objects may optionally, but less preferably, provided without the trailing body or fins/wings, wherein the tubular bore that is received on the launcher shaft is a bore into the ball/object. Other projectiles may be provided that include known shapes, or pieces of known shapes, for example, missile or space-shuttle shapes, airplane, dart, or other known shapes with or without added tails, fins, wings or protrusions. Or, fanciful or new shapes may be created, which bear no close resemblance to conventional projectiles or flying machines. For example, projectiles may include, or be caricatures, of dragon head, horse head, bird head and/or full bodies of the same.

In certain embodiments, heads may be interchangeable on the projectile bodies. For example, a given body may connect to multiple heads, for increasing the variety of shapes, sizes, and types of heads a user may carry and play with, to vary the "payload" delivered by the "missile". For example, the user may switch from a rounded projectile head to a football-shaped head, or to a water-payload head. This will increase fun and play options and/or give adults the option to buy various heads as "accessories" rather than having to purchase the entire projectile each time.

Various materials may be used, but preferred materials include polymer and/or foam materials that are weather resistance and non-shattering. Especially-preferred materials are "skinned type polyethylene foam" and other soft pliable foams, including polyurethane. The preferred skinned, condensed polymer foam allows a projectile in the range of 4-15 inches (and more preferably 6-12 inches) to have a weight of 0.5-2 pounds (and more preferably 0.25-1 pound) that can be flung a long distance with the preferred launcher. Open-cell foam is desirable for portions of some projectiles so they can carry water, but condensed foam is still desired for some or all of the other portions of such projections, to providing enough projectile weight for long-distance flinging. The water carried by "water-fight" projectiles will add weight, as well, for long-distance flinging. The preferred material for the distal tip of the launcher is a soft and compressible foam, for safety reasons, as the hand-held launcher could theoretically be poked at someone and/or someone could run into another person's hand-held launcher.

Some embodiments may be used in non-toy applications, including but not limited to hunting, and search and rescue. For example, a hiker or explorer, or members of a hiking or exploring group, may signal others or each other by throwing whistling projectiles high into the air.

The launcher may be used to fling projectiles by throwing overhand, throwing underarm or sidearm, or by flinging from the user's chest, all of which actions may be catorized as "swinging the launcher". A classic baseball pitchers windup and delivery may be effective for a very long projectile flight, but other flinging actions may also be used as desired.

The preferred launcher and projection combination is preferably non-keyed, and the projectile can be put on the launcher shaft in any radial orientation. Many projectiles are symmetrical, but some need not be. The launcher shaft is preferably a single diameter rather than tapered and the launcher shaft comprises a stop, either at the proximal end or by means of the length of the shaft being sized to match the length of the bore of the projectile so that the stop is inside the projectile. This way, the projectile is easy to install without concern about how far the projectile is to be slid onto the launcher bar; the user simply slides the projectile onto the shaft until it is stopped by at least one stop. Also, the non-tapered and closely-matched diameters of the launcher shaft and projectile bore, provide non-wobbling and consistent and/or predictable cooperation/movement of the projectile along the launcher shaft prior to the projectile leaving the launcher, which non-wobbling, consistent and/or predictable cooperation/movement enhances the control the user may exert on the projectile and its trajectory.

The preferred biasing system provided between the launcher shaft and the projectile preferably holds the projectile in place both longitudinally and axially relative to the launcher, so the projectile won't spin around on shaft prior to release. This longitudinal and axial holding in place may be accomplished by a bias member fitting into one or more discrete recesses at selected locations inside the bore of the projectile, or by the bias member pressing sufficiently into a ring-style recess most or all the way around the bore of the projectile so that the projectile will not rotate under normal forces of flinging. Alternatively, if the bias member is attached (less preferably) to the projectile bore rather than the launcher, then the bias member may fit into one or more discrete recesses at selected locations on the outside of the launcher shaft, or by the bias member pressing sufficiently into a ring-style recess most or all the way around the shaft of the launcher. In other words, there are a biased pressure member and cooperating recess(es) provided on the preferred projectile bore and preferred launcher shaft member, instead of just a very tight fit between the generally cylindrical surfaces of the bore and shaft. As described earlier in this document, the bias member(s) and recess(es) are preferably provided near the rear (back, proximal) end of the launcher shaft, and the rear (back, proximal) end of the projectile tube/bore, respectively, in an area in which the projectile covers the launcher shaft, rather than front (distal) ends of the of the launcher and projectile. Also, preferably, no magnetic system is used to hold the projectile on the launcher.

In many embodiments, the desired or optimal use of the throwing device will be achieved by sizing and shaping the launcher and projectile, and the shaft and bore/tube, relative to each other, so that the center of gravity (center of weight) of the installed projectile is located at a location along the front half (distal half) of the launcher shaft. Most preferably, the center of gravity of the installed projectile is within about the front 20% of the shaft, but not at a location forward of (off of) the launcher shaft. For example, with a launcher shaft that is 8-12 inches long, the center of gravity of the projectile would be located somewhere along the front (distal) 1.6-2.4 inches of the shaft. Especially in the case of large projectiles, the protrusions preferably provided on the trailing body (such as "tail fins" or "tail wings") may extend rearward past the launcher shaft, for example, extending near but not interfering with the hand grip region of the launcher or the user's hand. This may allow the larger projectiles to fit appropriately on the launcher, with their center of gravity in the desired location at or near the distal end of the shaft.

Pressure from the bias member holds the projectile on the shaft during the back-throw (the "pull-back", wherein less force is produced), but allows the centrifugal force to release the projectile during the later stages of the follow-through (made up of the forward fling with abrupt stop or full overhand throw, wherein more force is produced compared to the pull-back). In other words, the bias member is designed so that it holds the projectile on the launcher during the back-throw but the user's forward motion creates sufficient force to overcome the pressure of the bias member, releasing and flinging the projectile in spite of the bias member.

Both the projectile bore and launcher shaft are preferably cylindrical and close in diameter size, which provides a smooth and predictable interaction and movement of the projectile relative to the launcher shaft. The bore is slightly larger than the shaft, but by preferably only about ⅛-1/32 inch, and more preferably about 1/16 inch. This close but smooth, low-friction cooperation between the projectile and the launcher shaft causes better, cleaner and more accurate guidance and subsequent release of the projectile from the launcher. The small difference between the launcher shaft and the projectile bore may cause the projectile to be slightly offset from coaxial with the tube, but this very slight offset still tends to prevent wobbling of the projectile on the launcher while it reduces the contact surface area between the shaft and bore as the projectile flies off of the launcher, thus further reducing friction. The contact surface area will typically be a narrow longitudinal strip/area of the cylindrical surfaces along the length of the launcher shaft and the projectile bore.

Other Possible Objects and Embodiments

In alternative embodiments (not shown), the launcher shaft retracts into the handle after flinging the projectile, for making the launcher smaller and providing an element of surprise for the user. This may be accomplished through utilization of a spring mechanism, which pulls the shaft into the handle after the projectile has been released from the launcher. Or, the launcher may be adapted so that, upon pushing a button, the launcher shaft pops out from handle, ready for use (like a "light saber").

In alternative embodiments (not shown), the launcher may comprise a mechanism for lengthening the launcher shaft. For example, an outer launcher shaft, which is not affixed to the launcher handle, may be slideably connected to a smaller shaft that is affixed to the launcher handle. The outer shaft could slide/telescope out from the smaller shaft, and be locked/latched in that configuration to lengthen the effective shaft length of the launcher. Locking/latching in the extended configuration could be done, for example, by twisting the outer shaft to latch in a notch or other latch mechanism, so that the outer shaft would at least temporarily not slide relative to the smaller diameter shaft. The purpose would be to allow much longer projectiles to be fitted on the launcher device and to utilize the added length for better flinging performance for the longer projectiles. The lengthening process could be reversed to return the launcher to the smaller size for smaller projectile launching.

In alternative embodiments (not shown), the projectile and launcher shaft may be keyed with a twist pattern (like rifling), so that the projectile spins prior to leaving the launcher and continues during flight. Alternatively, a motorized spin feature may be provided, for example, so that that the launcher shaft rotates and causes the projectile to also rotate (spin) prior to launching, so that the projectile is urged to spin prior to launching and will continue to spin during flight. Alternatively, a pull-string feature may be used to cause the projectile to spin prior to launching so that it continues to spin during flight.

Referring Specifically to the Figures:

Referring specifically to the figures, one may see several, but not the only, embodiments of the invented toy device. The device comprises a launcher and at least one projectile that cooperates with the launcher. The launcher may comprise a shield, a detachable shield, or no shield at all. In cases of the shield being attachable/detachable, any conventional detachable connection, for example tight-fitting pin-style connectors C in FIG. 5, may be used. The launcher and projectile may comprises some or all of the features and/or capabilities described above in the above "Objects" sections.

Figure 2:
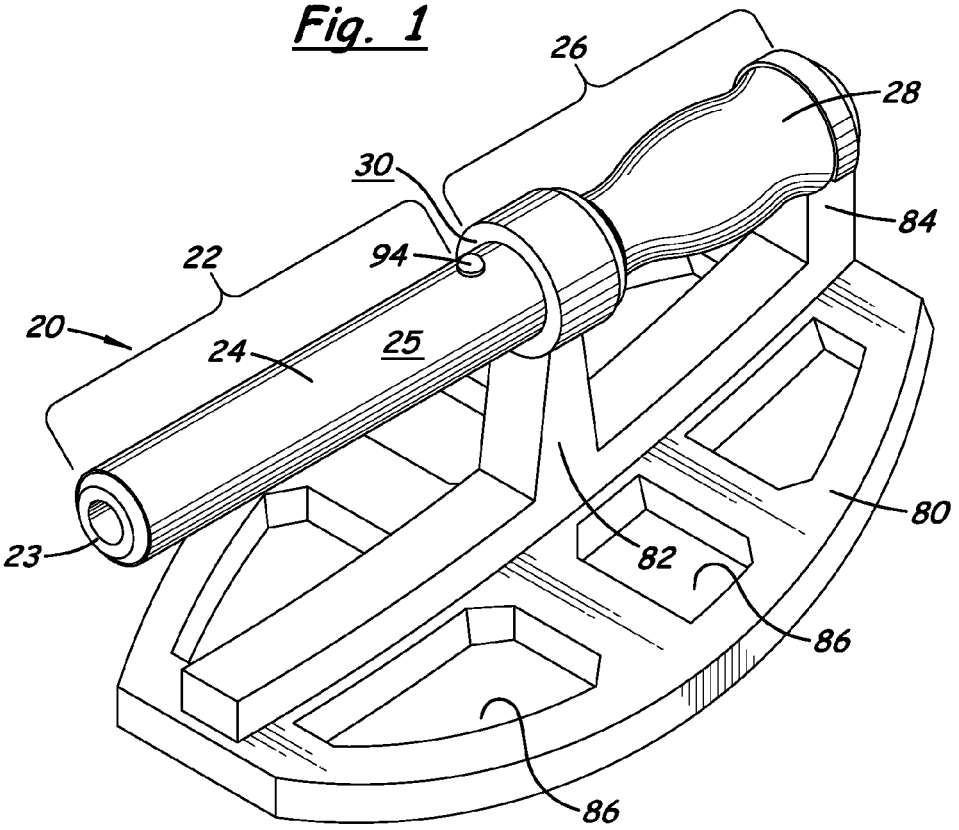
FIG. 2 is a side perspective view of the launcher of FIG. 1.

FIGS. 1 and 2 portray an embodiment of the device 10 that comprises a launcher 20 with a shaft 22 with a cylindrical or generally cylindrical shaft wall 24, for receiving a projectile 50. The shaft 22 may be hollow for receiving bias system structure or other structure, but, alternatively, may be solid if other provision is made for housing said bias system or other structure. The combination is assembled for use, by means of the projectile 50 being slid onto the launcher shaft 22 into the position shown in FIG. 1. A distal-facing stop surface 30 of the handle portion 26 may serve as a stop for limiting the rearward movement of the projectile 50.

A user grips the grip 28 and swings the device 10 to release the projectile 50 from the launcher 20. The grip 28 may be contoured for ergonomics, comfort and/or a good grip. After launching or other removal of the projectile, the launcher appears as in FIG. 2. The tip 23 of the launcher shaft 22 is preferably a foam pad or other cushioning material, so that, during times when the projectile is not covering the shaft 22, the shaft 22 will not be dangerous.

In FIGS. 1 and 2, the launcher appears to be resting on a plate or other generally planar member, which may be considered and used as a shield 80. The shield is connected to the handle portion 26 of the launcher, near the handle grip 28 but leaving room for the fingers and thumb to encircle the grip 28. Also, the shield 80 is not attached, and does not come near to, the shaft 22, so that the shield does not interfere with the installation and flinging of the projectile 50. The shield 80 may be connected by various structure or fasteners, such as connector bars 82, 84 that are distal and proximal of the space through which the fingers/thumb will reside during use of the device 10. The shield 80 preferably is only partially solid, that is, it preferably has apertures 86 so that a user can see through parts of it, and/or to reduce the overall weight of the device.

When describing the launcher shaft and the projectile, the terms "distal" and "proximal" are used to refer to a direction away from the user (and away form the hand grip) and a direction toward the user and the hand grip, respectively. When describing the shield, the term "front" of the shield is used, as the user would probably hold the device in front of himself/herself with the outer surface of the shield facing forward away from the user.

The launcher shaft 22 is a preferred member for receiving the bore of the projectile 50. However, the shaft 22 is one example of many different shafts that may be used to receive the bore of the projectile. For example, the launcher shaft may be cylindrical (as in the shaft 22 shown in the figures), oval, square, keyed or not keyed to a mating bore, and other shapes.

Figure 19:
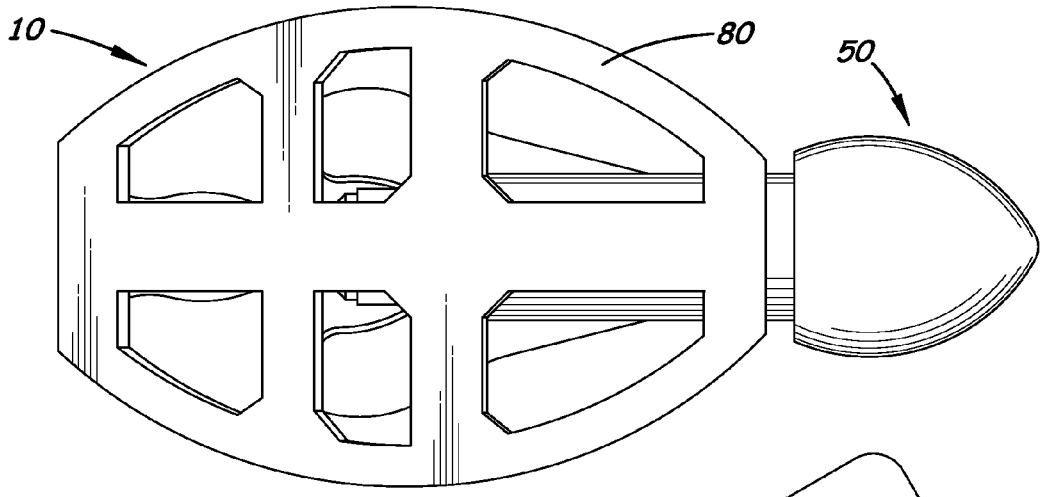
FIG. 19 is a front view of the embodiment of FIG. 1, showing to best advantage the front surface of the shield. The shield is preferably wider than the rest of the launcher, wider than the projectile, and extends to cover and shield the hand grip and most of the installed projectile.

The shield 80 may be used to protect the user from others' projectiles, for example, by the user holding the device (with the shield forward) in front of him/her. Or, the user may knock incoming projectiles away from their path by hitting them with the shield. "Close combat" play may be done between two users, for example, by bumping the shields together. The shields, therefore, are foam, condensed foam, or other polymeric material or other material that will tend to bend or compress and not hurt a child or person if the shield is pushed against the child/person. FIG. 19 shows a front view wherein one may see the front side of the shield, and how the device might appear when held out across the user's chest in a defensive posture.

Figure 3:
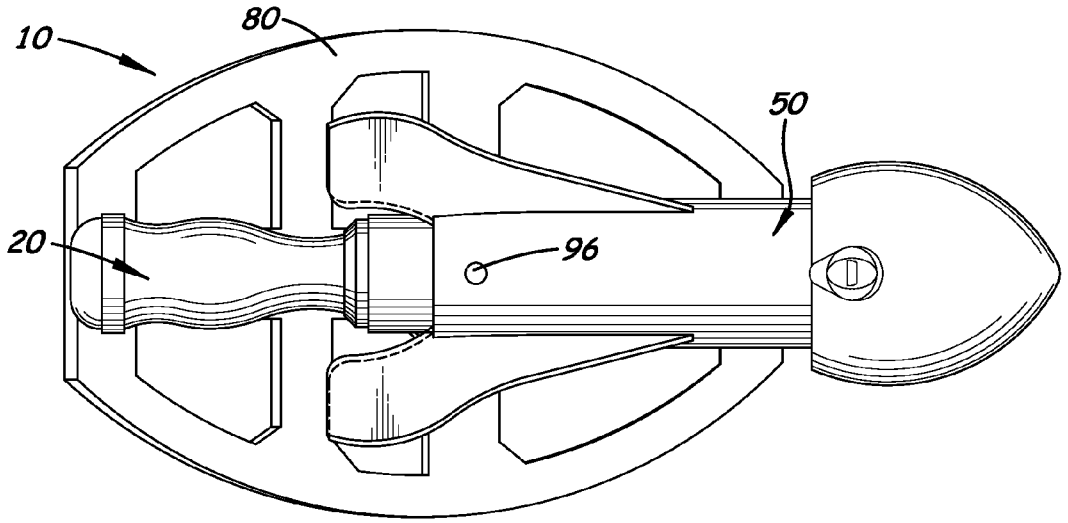
FIG. 3 is a rear view of the embodiment of FIG. 1.
Figure 4:
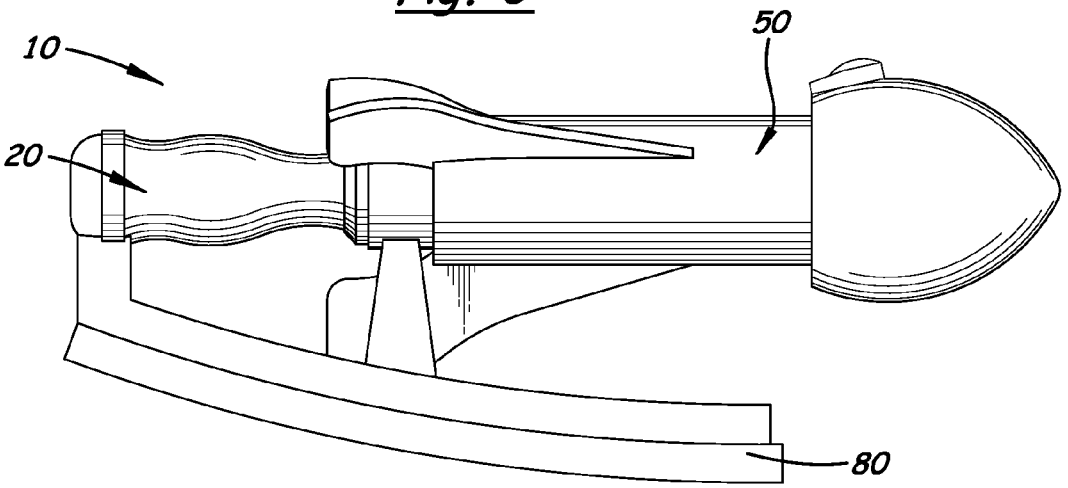
FIG. 4 is a side view of the embodiment of FIG. 1.
Figure 5:
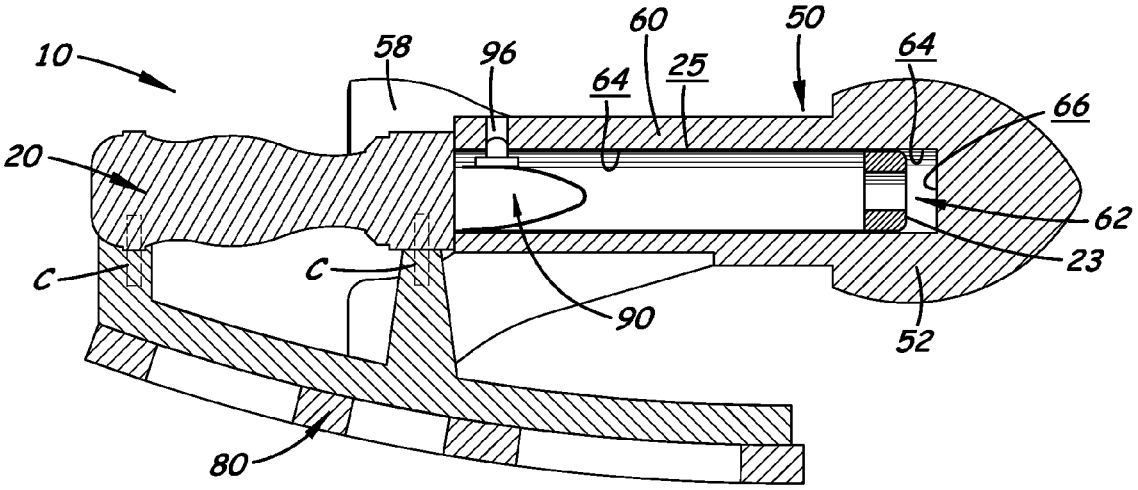
FIG. 5 is a cross-sectional view of the embodiment of FIG. 1.

FIGS. 3-5 show the device 10 in a top view, side view, and cross-sectional side view, respectively. One may see that the projectile 50 preferably has a length that is on the same order, and in some embodiments, within about 1-20% longer that the length of the launcher including the shield. The projectile 50 distal end (head 52) protrudes out beyond the distal tip 23 of the shaft 22, and the handle portion 26 of the launcher protrudes proximally from the proximal-most extremity of the projectile, which is the rear edges 56 of the fins 58 in some embodiments or the rear edge of the body/tube in other embodiments, for example, The projectile, when installed, preferably covers the entire shaft, or in certain embodiments, 80-100% of the length of the shaft or 50-100% of the length of the shaft.

In device 10, and many but not necessarily all embodiments, the head 52 is enlarged compared to the body 60; one may describe such embodiments as having an enlarged generally spherical, conical, or pointed head, with a smaller-diameter, cylindrical, oval, square or other elongated tail/body fixed to and extending proximally from the head. It is desired in many embodiments to provide a projectile with a head that is at least 3 inches in width and 3 inches in length, and a tail/body that is at least 2 inches in diameter/width and at least 4 inches, and more preferably at least 6 inches, long.

The fins 58 are preferably provided on the body, and not on the head, of the projectile, and more preferably extending near to or beyond the rear edge of the body. Such a location(s) for the fins helps stabilize the flight of the projectile, and provides a missile-like trajectory. The fins may be curved or slanted to cause spinning, which may help in creating a predictable and accurate trajectory for the projectile. The curvature of fins 58 may be seen to best advantage in FIGS. 7-12. Three or four fins, spaced evenly around the circumference of the projectile's body 60, are preferred, but more may be used.

The projectile head 52 may be substantially solid (non-hollow) except for an area, if any, into which its bore 62 extends. The bore 62 may be of various lengths, with the length selected, or appropriate stop surfaces/mechanisms provided, to allow installation of the projectile on the launcher in the desired position relative to the launcher shaft length. As described earlier in this document, it is desired to have the center of gravity of the projectile at a location along the forward half of the launcher shaft, or even closer to the forward end of the launcher shaft but preferably not forward of the launcher shaft end. In certain embodiments, the stop that limits the rearward sliding of the projectile is a stop surface, such as stop surface 30. In alternative embodiments, the stop surface is the tip of the launcher shaft, such as tip 23, abutting against the inner end of the bore, such as against inner end surface 66. In alternative embodiments, the engagement system (or "bias system") may be the stop that controls how far rearward the projectile slides on the launcher; for example, the projectile may slide rearward on the launcher shaft until a bias member snaps into a circumferential groove in the projectile tube/bore. Other stop structure(s) may be provided.

Figure 13:
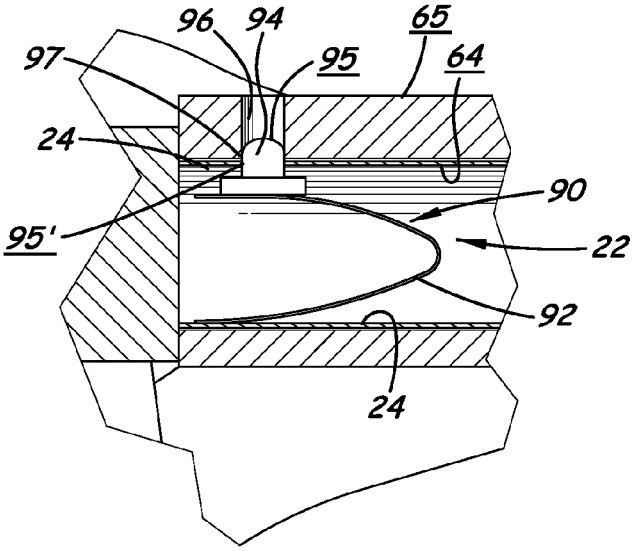
FIG. 13 is a cross-sectional, detail view of one embodiment of a bias system that may be used in embodiments of the invention. The spring-biased "button" member has a curved side surface that is pushed so that it retracts further into the launcher body to allow movement of the projectile relative to the launcher for release from the launcher.

FIG. 5 illustrates a preferred embodiment of a bias system 90 that holds the projectile 50 on the shaft 22 until the centrifugal force of the fling is great enough to send the projectile flying off the launcher in spite of the bias system. FIG. 13 shows bias system 90 in an enlarged detail view. This bias system 90 is especially effective in that it retains the projectile from sliding axially or radially, until said centrifugal force overcomes its bias and allows the projectile to fly. The bias system 90 comprises a spring 92 inside the shaft 22, and a button 94 on an outer end of the spring, wherein said button 94 protrudes through the shaft wall 24 and into a hole 96 on the bore surface 64 of the projectile. This hole 96 is slightly larger than the diameter of the button, and extends into the bore surface 64, so that, once the projectile is slid fully onto the shaft 22, the projectile may be rotated on the shaft 22 until the button snaps into the hole 96. Then, the projectile is held axially and radially in place until sufficient force is exerted to force the button inward against the spring bias, to allow the projectile to fly off the shaft. The button 94 preferably has rounded/curved top and side surfaces, to make the button a "mound" or "bump" shape, whereby the distally-directed force of rearward hole perimeter portion 97 against the button will tend to force the button inward toward the axis of the shaft 22, so that the button retracts from the projectile hole 96, and into the launcher shaft 22 or at least generally flush with the outer surface 25 of the shaft 22. If the button side surface extended straight out in a radial direction, rather than being rounded/curved, the rearward hole perimeter portion 97 would tend to catch on such a radial side surface with little chance of any force vector that would move the button out of the hole 96.

Figure 6:
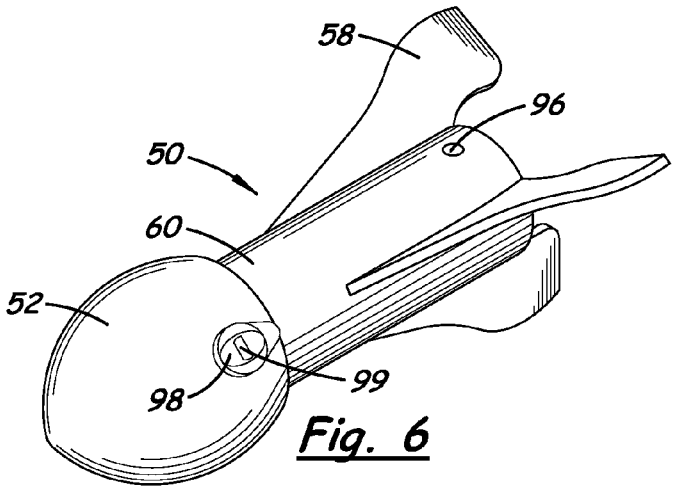
FIG. 6 is a side perspective view of the projectile of FIG. 1.
Figure 7:
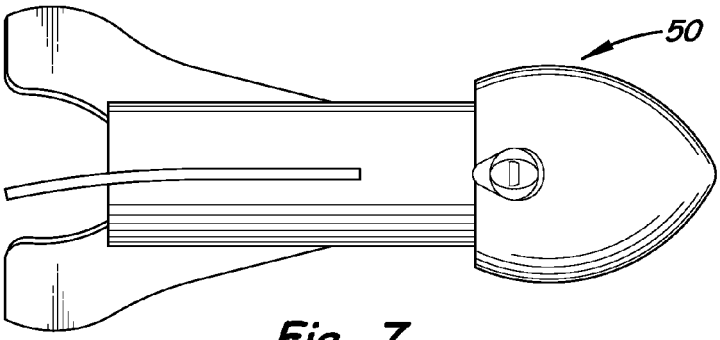
FIG. 7 is a side view of the projectile of FIG. 1.
Figure 8:
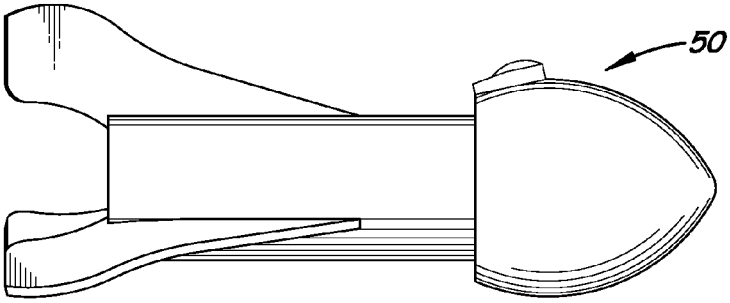
FIG. 8 is a side view of the projectile of FIG. 1, wherein the projectile is rotated a few degrees from its position in FIG. 7.
Figure 9:
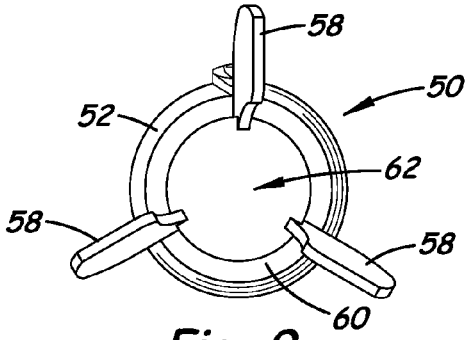
FIG. 9 is a proximal end view of the projectile of FIG. 1.

The hole 96 in FIGS. 5 and 13 is a hole that extends all the way through the wall of the projectile body 60, from the inner surface (bore surface 64) of the body to the outer surface 65 of the body 60. This through-hole approach allows the user to see the hole and estimate how the projectile should be installed on the shaft to allow mating of the button 94 and the hole 96 (see FIGS. 3, 5, and 6, for example). This is not absolutely necessary, however, as the preferred projectile may be rotated on the preferred shaft until the button snaps into the hole. Alternatively, a hole/recess may extend just part way into the wall of the projectile body 60. The spring may be installed as shown, between opposite inner surfaces of the shaft interior, or in a bracket or other holder or retainer in the shaft, for example. The spring may be spring steel, for example, and spring strength may be selected without undue experimentation.

Various views of projectile 50 are shown in FIGS. 6-9, highlighting the general shape of this missile. The substantially solid head 52, the substantially hollow shaft 22, and their relative sizes, may provide a center of gravity that is on the longitudinal axis of the projectile but is distal of the midpoint along the longitudinal axis. In other words, more than half of the weight, and as much as 55-80 percent in many embodiments, is in the distal half of the projectile.

A whistle 98 is provided on the head 52, in a position in which the passing air will interact with the whistle to make whistling sounds as the projectile 50 flies. An on-off switch 99 may be provided, to allow a both a "stealth" mode and a "sound" mode. As described elsewhere in this document, lights, indicia, or decoration may be provided on the projectile and/or the launcher. For example, multiple devices 10 may be provided, with two types of indicia or colors, and teams may form and identify each other by the indicia and/or color. Indicia or colored tags or portions may be provided that are changeable, for example, between red and blue, so that one team member may "capture" and "recruit" members of the opposing team (the captured parties switching team indicia/color) to increase their own team's numbers until "victory" over, or "surrender" of, the smaller team.

Figure 10:
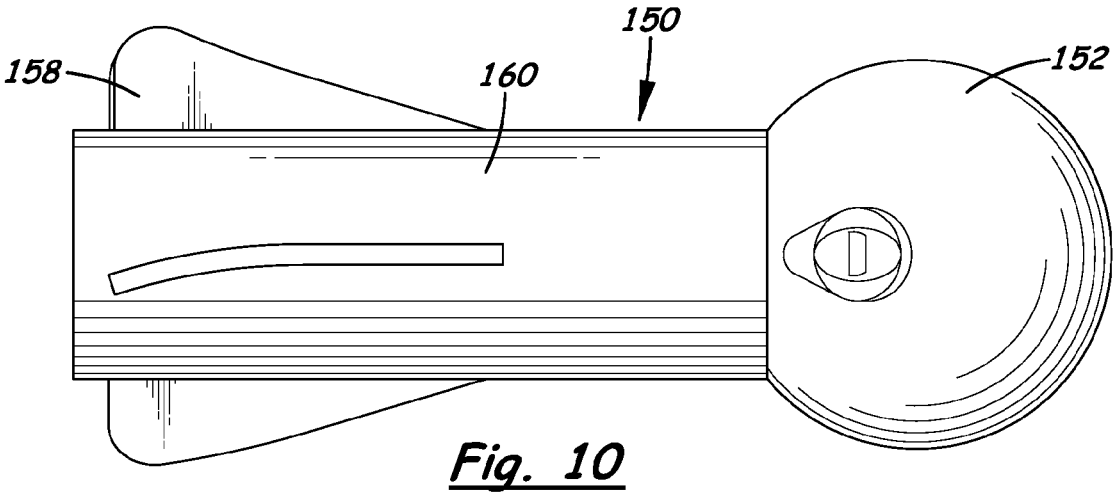
FIG. 10 is a side view of an alternative embodiment of a projectile for use with a launcher according to an embodiment of the invention.
Figure 11:
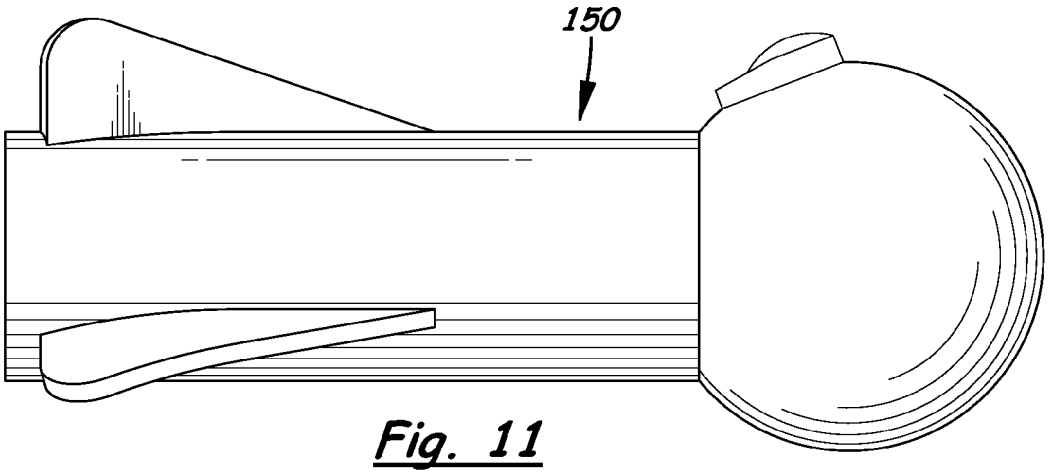
FIG. 11 is a side view of the projectile of FIG. 10, rotated a few degrees from its position in FIG. 10.
Figure 12:
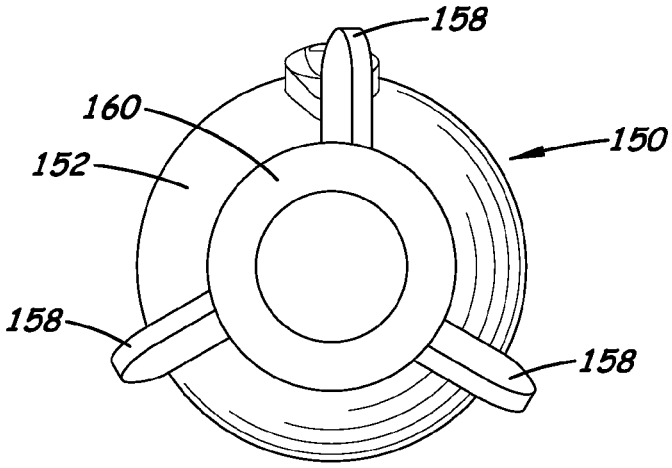
FIG. 12 is a proximal end view of the projectile of FIG. 10.

FIGS. 10-12 illustrates one of many possible alternative projectiles 150, which has a round head 152 rather than a pointed head 52, and a generally cylindrical body 160 and fins 158 much like those of device 10. Many of the features of projectile 50 are included in projectile 150, including fin curvature and a whistle. In this projectile 150, the weight distribution may be generally distal for example, greater than 50 percent, and preferably 55-80% of the weight being in the distal half of the projectile.

Figure 14:
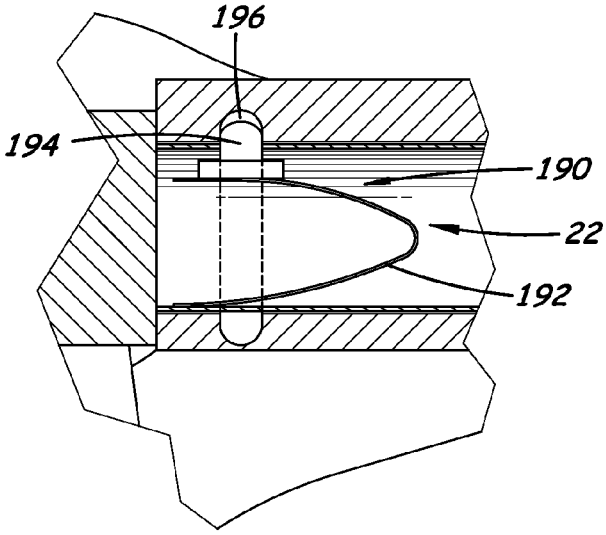
FIG. 14 is a cross-sectional, detail view of an especially-preferred embodiment of a bias system that may be used in embodiments of the invention, wherein the spring-biased button member is urged into a circumferential groove in the projectile. This groove, and other embodiments wherein a recess is provided around the entire circumference of the projectile tube, allow the projectile to be installed on the launcher without aligning the projectile in any particular rotational orientation.
Figure 15:
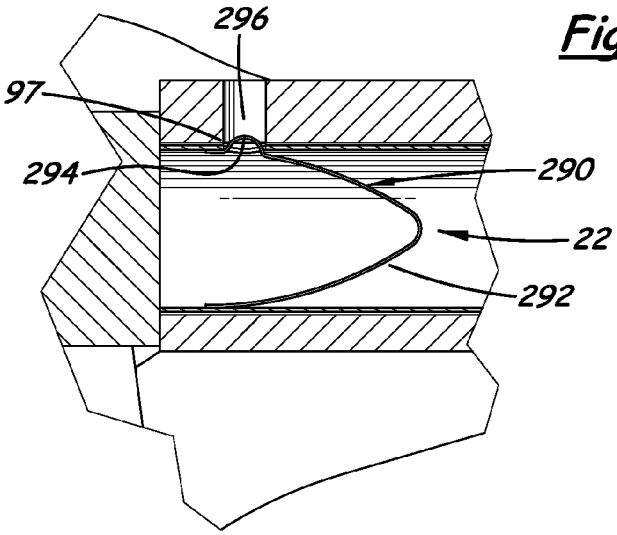
FIG. 15 is a cross-sectional, detail view of another embodiment of a bias system that may be used in embodiments of the invention, wherein a portion of the spring member is urged into a hole in the projectile.

Various, but not all, possible bias systems are detailed in FIGS. 13-18. FIG. 13 portrays bias system 90 described above. FIG. 14 portrays another spring bias system 190 that includes a spring 192 and button 194 much the same as those in bias system 90, but wherein the recess 196 is an annular groove that extends all the way around the inner circumference of the hollow projectile body. Bias system 190 will hold the projectile axially, as discussed earlier in this document, and will hole the projectile radially to some extent due to the pressure of the button, but may allow rotation of the projection on the shaft 22 if the user purposefully rotates the projectile relative to the shaft. As described above for FIG. 13, the rounded/curved side surface of the button of FIG. 14 will be forced to retract from the annular groove to release the projectile. FIG. 15 portrays a bias system 290 wherein the spring 292 comprises an outwardly curved portion 294, which acts much like buttons 94, 194. Curved portion 294 is urged into the hole 296, until the centrifugal force overcomes the spring force and the rearward hole perimeter portion 97 forces the curved portion to moves inward (with the rest of that spring arm) out of the hole 296 to allow the projectile to fly.

Figure 16:
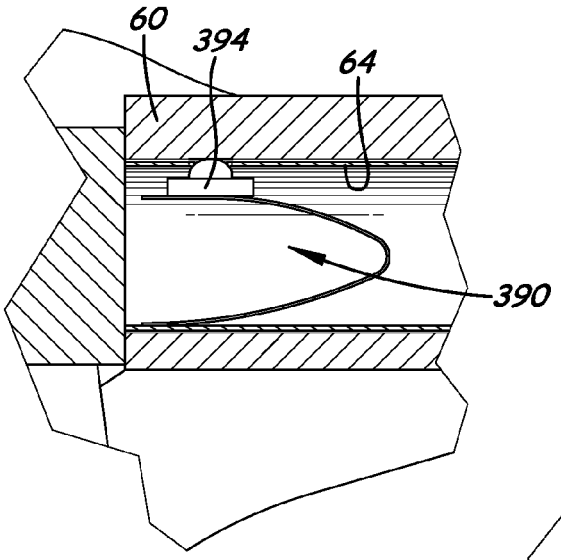
FIG. 16 is a cross-sectional, detail view of another embodiment of a bias system that may be used in embodiments of the invention, wherein a spring-biased button member protrudes through the launcher wall to press against the inner bore surface of the projectile, without their being a recess/hole in the bore surface.

FIG. 16 portrays a bias system 390 wherein the spring-biased button 394 presses out against said inner surface (bore surface 64) of the body 60, but there is no recess or hole in the inner surface (bore surface 64) of the hollow projectile body to receive the button 394. This bias system 390 is less preferred, as it may not be as consistent and predictable as other button/curved-portion and recess/hole bias systems.

Figure 17:
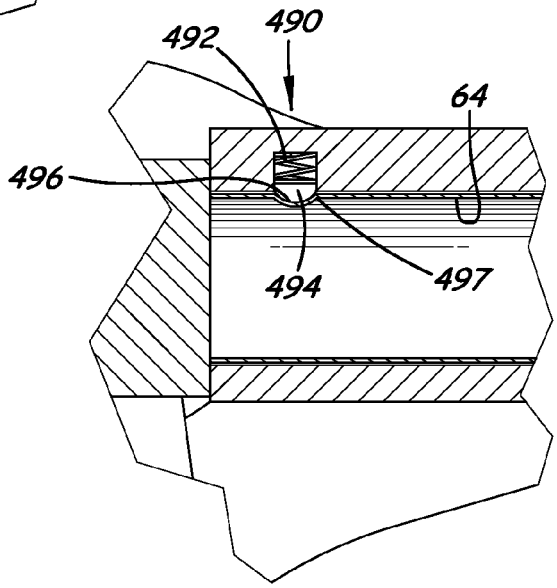
FIG. 17 is a cross-sectional, detail view of another embodiment of a bias system that may be used in embodiments of the invention, wherein a spring-biased member provided in the projectile is urged into a recess in the launcher shaft. The spring-biased member has a curved side surface that is pushed so that it retracts further into the projectile body to allow movement of the projectile relative to the launcher for release from the launcher.

FIG. 17 portrays an embodiment wherein the bias system 490 comprises a spring 492 and spring-biased button 494 that is biased out from the bore surface 64 of the body of the projectile. The button 494 protrudes into a recess 496 in the wall of the shaft. Alternatively, the recess in the shaft may be an annular groove that extends around the circumference of the launcher shaft. One may understand from FIG. 16 and the discussion above, that the rounded/curved side surface of this button 494 will be pushed, due to the centrifugal force working to move the projectile distally relative to the launcher shaft, by the distal recess perimeter portion 497 of the launcher. Thus, portion 497 will force the button 494 to retract into the projectile body to allow release of the projectile.

The embodiment of FIG. 17 is one of multiple possible embodiments that may comprise an arrangement wherein the bias member is biased from the projectile to the launcher, rather than an arrangement wherein the bias member is biased from the launcher to the projectile. In either arrangement, the bias is preferably strong enough that anything except a fairly strong throwing action keeps the projectile on the launcher. The effective throwing action may range from fairly strong to very strong, which will allow for the trajectory of the projectile to reach different distances. However, simple tipping the launcher and projectile down, so their distal ends point generally downward, should not allow the projectile to fall off the launcher. Also, a gentle waiving motion, as one might do to signal or point to a friend or team member, should not allow the projectile to fly off the launcher. One of skill in the art will be able to select a spring bias that will meet these needs, after reading and seeing this disclosure.

Figure 18:
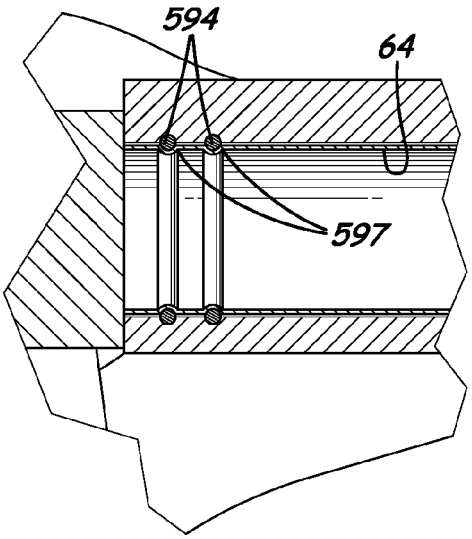
FIG. 18 is a cross-sectional, detail view of another embodiment of a bias system that may be used in embodiments of the invention, wherein o-rings or other seals protrude from the bore surface of the projectile, and are resiliently received in circumferential recesses in the launcher shaft. These o-rings/seals are biased into the circumferential recesses by virtue of their resiliency, rather than by springs, and have curved side surfaces that are pushed so that they retract (partially flatten) further into the projectile body to allow movement of the projectile relative to the launcher for release from the launcher.

FIG. 18 portrays a less-preferred embodiment that utilize cooperation between o-rings 594 on the inner surface (bore surface 64) of the projectile body and annular (circumferential) grooves 596 in the outer surface of the shaft. The o-rings should be somewhat compressible, so that the projectile may be slid onto the shaft of the launcher, but so that they expand to mate with the grooves when properly aligned with the grooves. Also, upon sufficient centrifugal force, the o-rings will compress to retract toward the projectile body to allow release of the projectile. This way, no springs are used, as the resilience of the o-rings serves as the bias mechanism. The side surfaces of the o-rings are curved, and the distal groove perimeter portion 597 will press on the o-rings, upon sufficient centrifugal force, to compress them into their holder grooves in the bore surface 64 of the projectile. Thus, while these o-rings are not provided on, or part of a spring, they act similarly to the spring-biased members that have curved side surfaces that are pushed out of the way to allow projectile release. The o-rings or other resilient members may be replaced if lost, or refurbished for an appropriate mating fit, by occasional removal and replacement from the open proximal end of the projectile.

Figure 20:
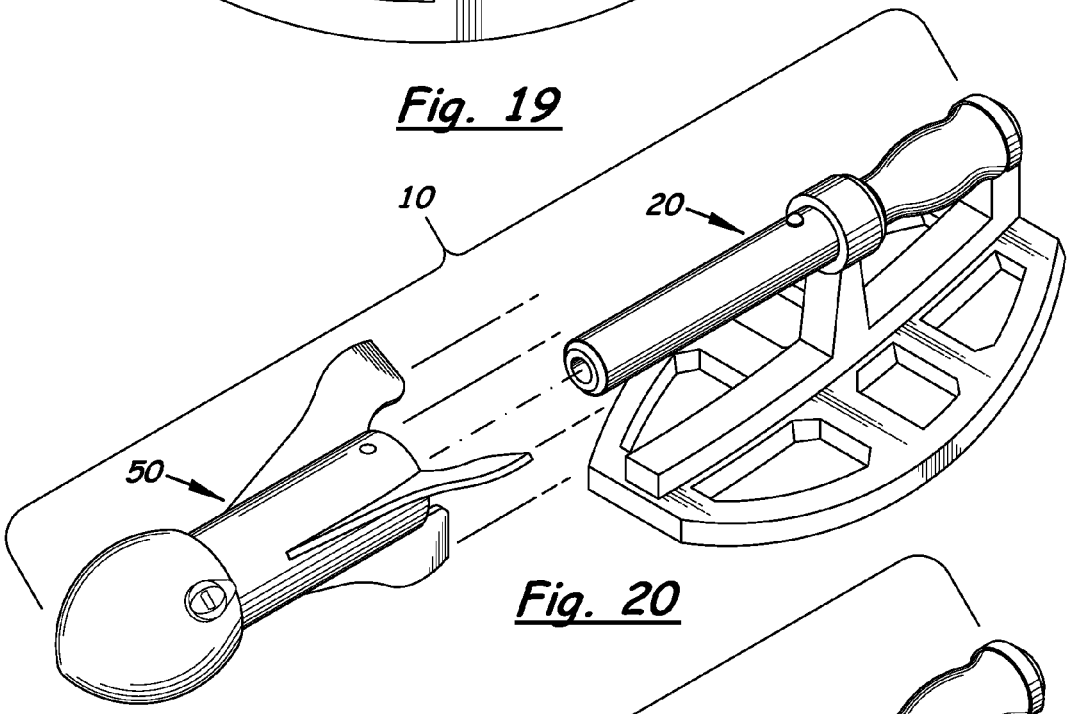
FIG. 20 portrays the embodiment of FIG. 1, wherein the projectile has been released from engagement with the launcher by centrifugal force, and is flying in its trajectory away from the launcher.
Figure 21:
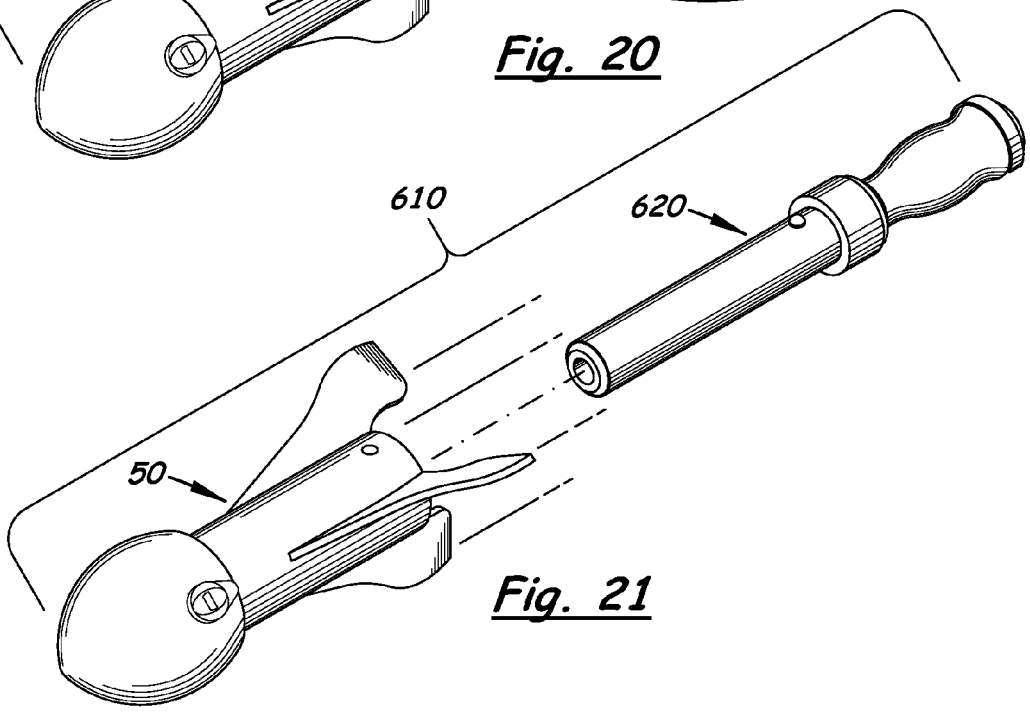
FIG. 21 portrays an alternative embodiment of the invention, wherein the launcher does not have a shield or the shield has been removed, and wherein the projectile has been released from engagement with the launcher by centrifugal force, and is flying in its trajectory away from the launcher.

FIG. 20 portrays the device of FIGS. 1-5 in use, wherein the user has just swung the device forward and the projectile has become released from the launcher and is flying. FIG. 21 portrays use of an embodiment 610, wherein the launcher 620 does not comprise a shield (or the shield has been removed) but the bias mechanism and launch methods are the same as in device 10.

Figure 22:
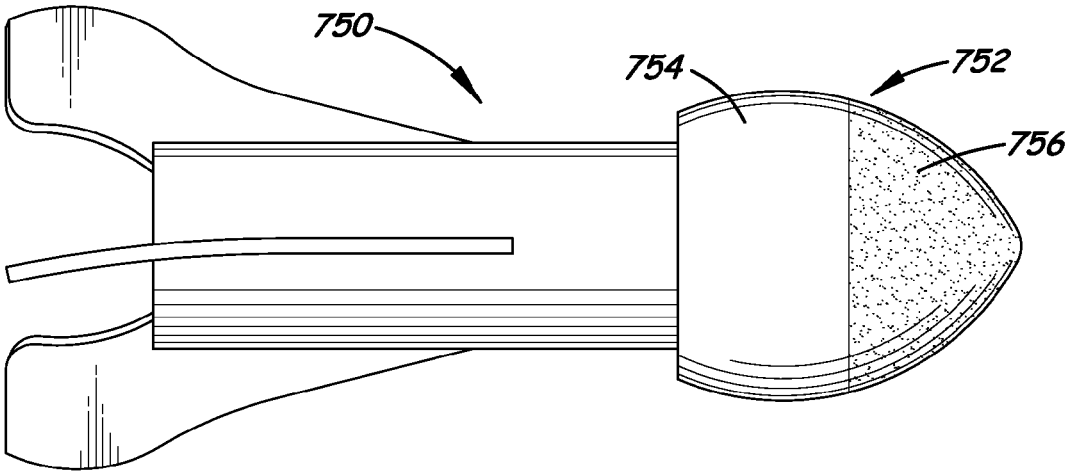
FIG. 22 is a side view of an alternative embodiment of a projectile that has a head with a distal-most tip that is open-cell foam for carrying water or other liquid.

FIG. 22 portrays one, but not the only, embodiment of a projectile 750 that comprises an open-cell foam portion for carrying water. The head 752 has a generally solid or sealed/skinned portion 754 and an open-cell foam portion 756. This projectile may be dipped, submerged, or sprayed in/with water or other liquid, and the open-cell foam portion 756 will pick up a significant amount of water/liquid for games and play combat. Other materials that can carry water or become wet or liquid-soaked may be used, for example, to splash or mark an adversary or an object. Open-cell foam is preferred, however, because it will tend to release the water easily when the person or object is hit, creating an excellent splash or exciting spray effect.

Figure 23:
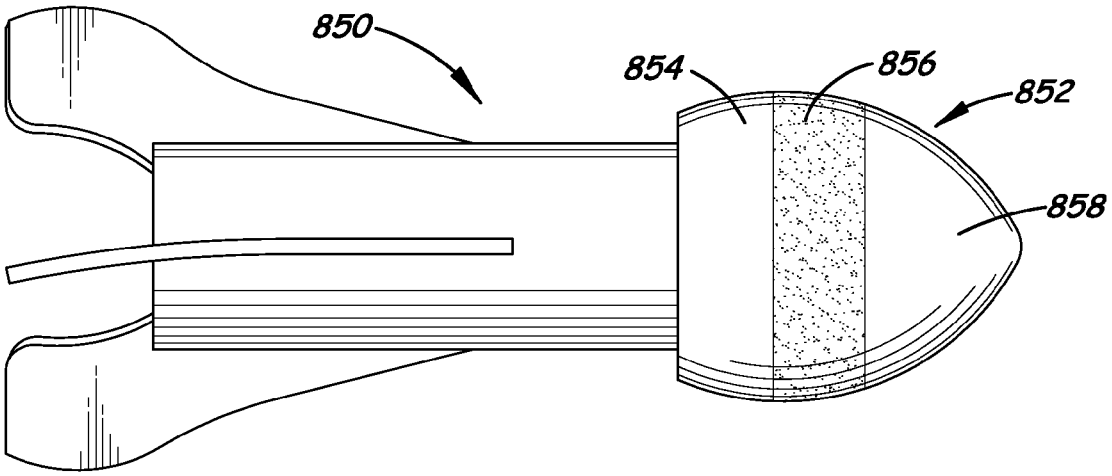
FIG. 23 is a side view of an alternative embodiment of a projectile that has a head with a layer of open-cell foam for carrying water or other liquid, the layer being between two regions of non-water-carrying material.

In FIG. 23, projectile 850 comprises a head 852 having a water-carrying portion 856 that is sandwiched between two solid or sealed portions 854 and 858. This may create a different splash/spray effect, for example, a circular spray out from the projectile when it hits a target/person. Other water/liquid-carrying or wettable portion(s) may be provided, or the entire head of the projectile may be water-carrying or wettable.

Figure 24:
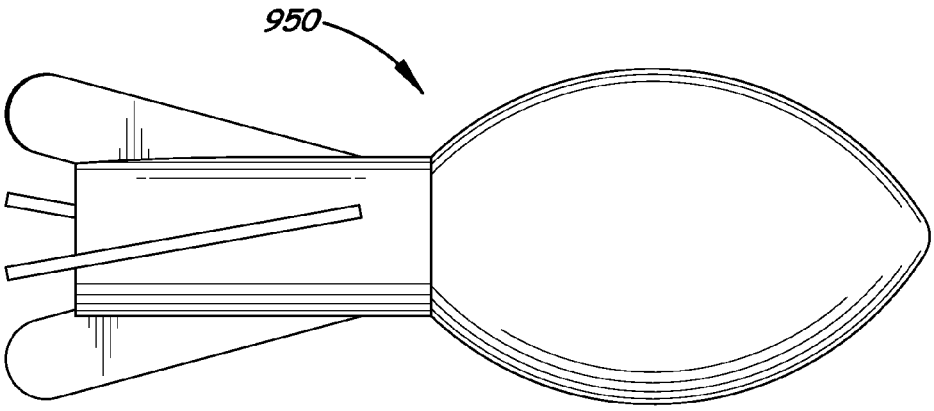
FIG. 24 is a side view of an alternative embodiment of a projectile, which comprises a head shaped like a football.

In FIG. 24, one may see a football shaped projectile 950, wherein the head is approximately 90 percent of a football, with the remaining 10% removed from the rear football end to form a flattened area for connection of the body (tail) of the projectile. The fins on the body are slanted, rather than curved, as an example of an alternative shape of fins that may cause a spinning/spiraling trajectory.

Figure 25:
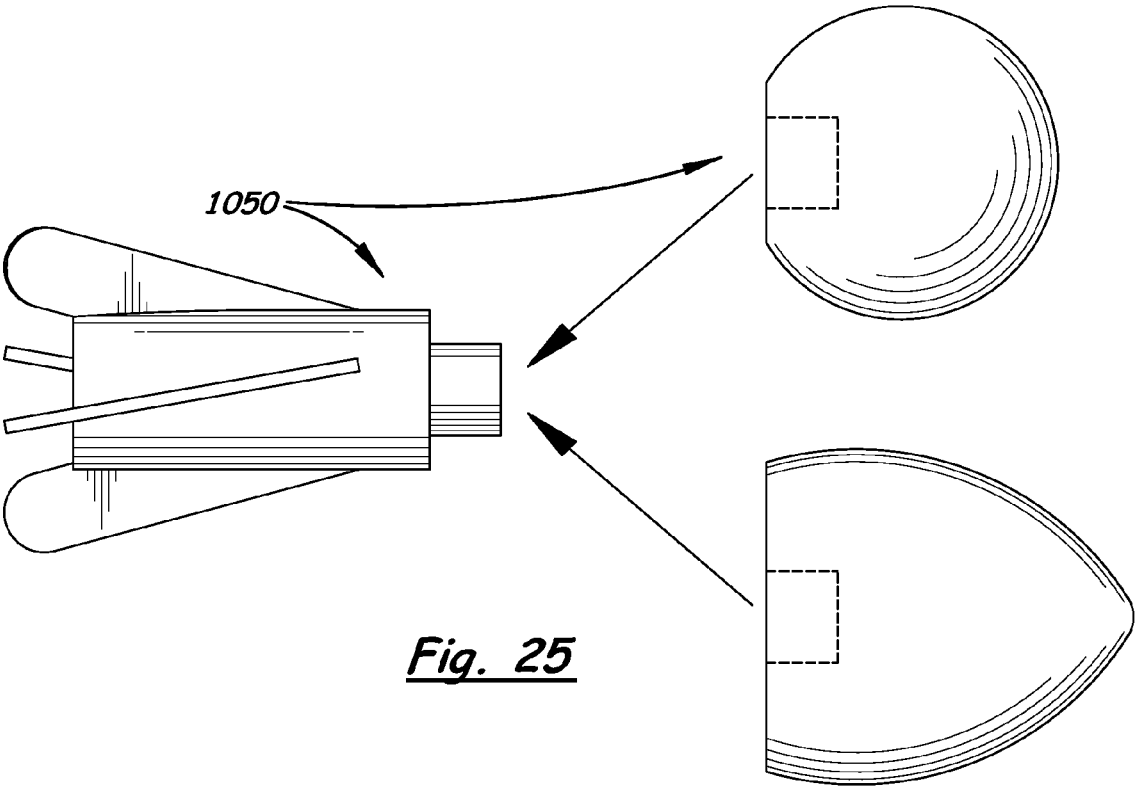
FIG. 25 is a side view of an alternative embodiment wherein heads may be interchanged on a projectile body, for example, by a friction-fit connection.

In FIG. 25, one may see an example of an embodiment 1050, wherein the connection between head and body is detachable for a user to use interchangeable heads. The detachable connection may be a friction-fit connection, for example, but other detachable connections may be used.

It may be noted that the preferred bias system, wherein a spring-biased member protrudes to be received in a hole or recess of a cooperating surface, has advantages compared to a tight fit and/or a protruding portion of a shaft gripping a smooth or planar cooperating surface. The spring-biased member-recess/hole cooperation causes certain and predictable engagement of the projectile and launcher. The cooperation of the spring-biased member and the recess/hole, combined with a snug but not tight fit of the projectile bore on the launcher shaft, provides consistent and predictable engagement of the projectile with the launcher, but not high-friction contact of the projectile bore surface with the launcher shaft surface.

Certain embodiments of the projectile-launching toy may be described as comprising: a launcher comprising a proximal end and a distal end, a handle at or near the proximal end and an elongated shaft at the distal end having a hollow space at least part way along the length of the elongated shaft; a projectile having a bore defined by an inner surface, the projectile slideably received on the elongated shaft, and the bore having a recess or hole in the inner surface; and a bias system comprising a spring inside said hollow space of the elongated shaft, a button biased by the spring to extend out from the elongated shaft to be received in said recess or hole in the inner surface of the projectile to retain the projectile on the launcher elongated shaft in a preparatory position, wherein the projectile remains in said preparatory position until the launcher is swung to create a centrifugal force, wherein the button has a curved side surface and centrifugal forces cause the projectile to push against the curved side surface to move the button inward toward a longitudinal axis of the elongated shaft so that the projectile slides over the button and off the launcher on a trajectory forward from the launcher. The projectile may have a distal head and a proximal body, fins extending out from the proximal body, and a center of gravity distal from a point along the longitudinal axis midway between a distal-most end and a proximal-most end of the projectile. The distal head may be larger in diameter than the diameter of the proximal body. A distal half of the projectile may be heavier than a proximal half of the projectile. The projectile may comprise a whistle that has an on-off switch. The projectile may have curved fins extending out from the proximal body for causing the projectile to spin upon leaving the launcher. The distal head of the projectile may have a larger diameter than the diameter of the proximal body, and the distal head having a pointed distal tip. The distal head may be generally spherical. The distal head may comprise at least one region that is open-cell foam for carrying liquid. For example, the head may comprise multiple layers of open-cell foam between layers of non-water-carrying material. When installed in the preparatory position (prior to disengagement of the projectile and launcher shaft and distal sliding of the projectile on the shaft), the projectile covers the entire, or nearly the entire, elongated shaft of the launcher. The launcher may comprise a stop at a rearward extremity of the elongated shaft that is adapted to prevent the projectile from sliding rearward of the elongated shaft, in which case, the projectile would typically entirely cover the launcher shaft. Or, the engagement system bias member may serve as an engagement stop for the projectile, in which case the projectile would not typically slide so far rearward that it would cover the entire launcher shaft, but instead, would typically cover 70-99% of the launcher shaft, for example.

Certain embodiment of the invention may be described as a toy for throwing a projectile, the toy comprising: a hand-held launcher having a proximal end and an opposing distal end, a hand grip at or near the proximal end, and a shaft at the distal end; a projectile with a bore extending at least part way into the projectile along a longitudinal axis of the projectile, wherein the bore is defined by a bore surface and is slideably received the shaft; and a bias member urged to form a mating connection between the launcher shaft and the projectile, the bias system wherein a spring-biased member on a holder engages a cooperating member, the bias system being selected from the group consisting of: a spring-biased member provided in or on its respective holder that is said shaft, wherein the spring-bias member protrudes radially out beyond an outer surface of the shaft and is urged so that at least a portion of the spring-biased member protrudes into a hole or recess in the bore surface of the projectile that is its respective cooperating member; and a spring-biased member provided in or on a holder that is said projectile, wherein the spring-biased member protrudes radially inward beyond the bore surface and is urged so that at least a portion of the spring-biased member protrudes into a hole or recess in the outer surface of the shaft that is its respective cooperating member; wherein, upon flinging of the launcher by a user, centrifugal force causes the respective cooperating member to push distally on the proximal side-surface of the spring-biased member, so that the spring-biased member retracts out of said respective cooperating member and into the respective holder so that the projectile flies distally off of the launcher.

Certain embodiments of the invention may be described as a toy for throwing a projectile, the toy comprising: a hand-held launcher having a proximal end and an opposing distal end, a hand grip at or near the proximal end, and a shaft at the distal end; and a projectile with a bore extending at least part way into the projectile along a longitudinal axis of the projectile, wherein the bore is defined by a bore surface and is slideably received the shaft; wherein the projectile, when received on the shaft, covers the entire shaft, and wherein more than 50% of the weight of the projectile is in a distal half of the projectile. For example, 55-80% of the weight of the projectile may be in the distal half of the projectile. For example, the projectile may be selected from the group consisting of: a sphere with a tail, an oblong or conical head with a tail, a generally-pointed head with a tail, a football or soccer ball or baseball or basketball preferably with a tail, and an arrow with a soft arrow-head, or other missiles having a payload and a tail, wherein each tail preferably rigid or generally-rigid and has generally-radially-protruding members such as fins or wings. The launcher preferably does not have a shaft or "stick" that is long relative to the projectile length, and the shaft or "stick" of the launcher, defined as the shaft distal of the distal-most portion of the handgrip, is preferably about the same length or even slightly shorter than the length of the projectile (0-20 percent shorter than the projectile length, for example). The projectile, therefore, travels along a shaft that is about the same or slightly shorter than the projectile itself on its way to release, rather than traveling substantially more than one projectile-length before than leaving the launcher. In other words, even through the projectile does not travel along a relatively long shaft on its way to its leaving the launcher, the flinging device gives enough mechanical advantage that a projectile that is large and heavy compared to conventional foam darts can be flung a long distance with accuracy and consistency. Preferably the launcher handle and shaft are rigid and rigidly connected or rigidly integral with each other, and, therefore, do not flex significantly or at all during use. The preferred shield may be flexible or partially flexible.

One may understand from this description and the drawings, that more than one bias-member may be provided, for example, two or more spring-biased buttons and cooperating recesses/holes along the length of the projectile and launcher. Or, a single o-ring, or more than two o-rings, which are bias members by virtue of their resilience, may be provided as the bias members. Also, while the o-rings in FIG. 18 are shown as being retained in the bore surface and extending into the launcher grooves, the o-rings may be retained in the launcher shaft surface and extend into projectile grooves, as will be understood by one of skill in the art after viewing FIG. 18.

Preferably, there is no user-operated button release or other engagement release, other than the user's flinging the launcher and the consequent centrifugal force due to the flinging. Preferably, therefore, there is no handle, button, switch, or fastener that the user touches or operates to release the projectile. Preferably, there is no spring, wind-up, elastic, or other mechanized force to propel the projectile off the launcher, just force caused by the user's throwing action. Preferably, the only connection between the projectile and the launcher is the projectile being slid onto the launcher shaft, and the bias system that causes a temporary engagement between the projectile and the launcher, and there is no tie, elastic, clip, or pin between the projectile and launcher.

Certain embodiments may be described as consisting essentially of, or consisting of: a launcher with a handle portion and a shaft portion, a projectile received on the shaft portion, and a bias system including a spring and a button, wherein the button is either: urged from the launcher shaft to engage the projectile or urged from the projectile to engage the launcher shaft, wherein the engagement may be the button being received in a hole or recess in the projectile or launcher, respectively. Certain embodiments may be described as consisting essentially of, or consisting of: a launcher with a handle portion and a shaft portion, a projectile received on the shaft portion, and a bias system including a resilient member, wherein the resilient member resiliently extends from either the launcher shaft into a recess/hole in the projectile or from the projectile to into a hole/recess in the launcher shaft.

The terms "shaft" and "tube" are used herein to describe the cooperating cylindrical members or the preferred embodiments. However, in alternative embodiments, the terms may also include non-cylindrical members, such as oblong, square, or other shapes of elongated bars and bores for allowing the projectiles to be mounted on and to slide along the launcher until release to a trajectory.

Although this invention has been described above with reference to particular means, materials and embodiments, it is to be understood that the invention is not limited to these disclosed particulars, but extends instead to all equivalents within the broad scope of the following claims.

The invention claimed is:

1. A projectile-launching toy comprising:

a launcher comprising a proximal end and a distal end, a handle at or near the proximal end and an elongated shaft at the distal end having a hollow space at least part way along the length of the elongated shaft;

a projectile having a bore defined by an inner surface, the projectile slideably received on the elongated shaft, and the bore having a recess or hole in the inner surface; and a bias system comprising a spring inside said hollow space of the elongated shaft, and a button having a curved side surface, wherein the button is biased by the spring to extend out from the elongated shaft to be received in said recess or hole in the inner surface of the projectile to retain the projectile on the launcher elongated shaft in a preparatory position, wherein the projectile remains in said preparatory position until the launcher is swung to create a centrifugal force sufficient to push against the curved side surface to move the button inward toward a longitudinal axis of the elongated shaft so that the projectile slides over the button and off the launcher on a trajectory forward from the launcher.

2. A toy as in claim 1, wherein the projectile has a distal head and a proximal body, fins extending out from the proximal body, and a center of gravity distal from a point along the longitudinal axis midway between a distal-most end and a proximal-most end of the projectile.

3. A toy as in claim 2, wherein the distal head is larger in diameter than the diameter of the proximal body.

4. A toy as in claim 1, wherein a distal half of the projectile is heavier than a proximal half of the projectile.

5. A toy as in claim 1, wherein the projectile has a center of gravity forward from a point midway along the longitudinal axis of the projectile, and wherein, when said projectile is in said preparatory position, the center of gravity is located forward of midway along the length of the launcher elongated shaft.

6. A toy as in claim 1, wherein the projectile comprises a whistle that has an on-off switch.

7. A toy as in claim 1, wherein the projectile has a distal head and a proximal body, and curved or slanted fins extending out from the proximal body for causing the projectile to spin upon leaving the launcher.

8. A toy as in claim 1, wherein the projectile has a distal head and a proximal body, the distal head having a larger diameter than the diameter of the proximal body, and the distal head being selected from the group consisting of: a pointed head, a rounded head, a spherical head, a head comprising at least a portion that is adapted to carry water, a head comprising open-cell foam for carrying liquid.

9. A toy as in claim 1, wherein the projectile, when installed in the preparatory position, covers the entire elongated shaft of the launcher.

10. A toy as in claim 1, wherein the launcher comprises a stop at a rearward extremity of the elongated shaft that is adapted to prevent the projectile from sliding rearward of the elongated shaft.

11. A toy as in claim 1, wherein the bias system is adapted to prevent the projectile from sliding rearward on the launcher past said preparatory position.

12. A toy as in claim 1 wherein the launcher elongated shaft comprises a cushioning material at its distal-most end.

13. A triggerless toy for throwing a projectile, the toy comprising:

a non-pneumatic hand-held launcher having a proximal end and an opposing distal end, a handle at or near the proximal end, and a shaft at the distal end;

a projectile with a bore extending at least part way into the projectile along a longitudinal axis of the projectile, wherein the bore is defined by a bore surface and is slideably received on the shaft;

a spring biased member that protrudes radially out beyond an outer surface of the shaft and is urged so that at least a portion of the biased member protrudes into a hole or recess in the bore surface of the projectile and is camable inwardly by centrifugal force by the camming action of the recess or hole against the biased member upon non-pneumatic centrifugal force induced movement of the projectile created by swinging of the launcher;

wherein, upon swinging of the launcher by a user, centrifugal force causes the projectile recess or hole to push distally on a proximal side-surface of the biased member in a camming action, so that the biased member retracts out of the projectile so that the projectile flies distally off of the launcher;

wherein the spring biased member is located at or near a proximal end of said launcher shaft, so that contact of the bias member with the projectile is minimized after the bias member retracts out of the projectile and the projectile moves forward on the launcher shaft.

14. A toy as in claim 13, wherein the spring biased member is located in the rearmost ¼ portion of the length of the projectile, so that, at most, ¼ of the length of the projectile passes over the spring biased member upon retraction of the spring biased member into the shaft.

15. A toy as in claim 13, wherein the spring biased member is located in the rearmost ⅛ portion of the length of the projectile, so that, at most, ⅛ of the length of the projectile passes over the spring biased member upon retraction of the bias member into the shaft.

16. A toy as in claim 13, wherein the spring biased member is located in the rearmost 1/16 portion of the length of the projectile, so that, at most, 1/16 of the length of the projectile passes over the spring biased member upon retraction of the bias member into the shaft.

17. A toy as in claim 1, wherein the projectile is selected from the group consisting of: a sphere with a tail, an oblong head with a tail, a conical head with a tail, a generally-pointed head with a tail, a football with a tail, a soccer ball with a tail, a baseball with a tail, a basketball with a tail, an arrow with a soft arrow-head, a missile having a payload and a tail.

18. A toy as in claim 17, wherein the projectile includes a tail, and wherein the tail is a rigid or generally-rigid body having generally-radially-protruding fins extending from the body.

19. The toy of claim 1, wherein the curved side surface biased outwardly by said spring and adapted to coact with said recess in the inner surface of said projectile such that said curved side surface of said button is cammed inwardly upon movement of said projectile in response to centrifugal force.

* * * * *